US006917766B2

(12) United States Patent
Phillips et al.

(10) Patent No.: US 6,917,766 B2
(45) Date of Patent: Jul. 12, 2005

(54) METHODS AND APPARATUS FOR DISPENSING MEDIA SHEETS FROM A MEDIA STACK

(75) Inventors: Quintin T. Phillips, Boise, ID (US); Steven R. Folkner, Boise, ID (US); Jamison B. Slippy, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/613,899

(22) Filed: Jul. 3, 2003

(65) Prior Publication Data

US 2005/0002679 A1 Jan. 6, 2005

(51) Int. Cl.[7] ..... G03G 15/00
(52) U.S. Cl. ..... 399/23; 271/265.04
(58) Field of Search ..... 399/23, 393; 400/708; 271/110, 265.04

(56) References Cited

U.S. PATENT DOCUMENTS 6,422,773 B1 7/2002 Lim
6,585,344 B2 * 7/2003 Kolodziej ..... 347/19
2004/0114127 A1 * 6/2004 Todome ..... 355/407

FOREIGN PATENT DOCUMENTS

JP 02144351 A * 6/1990 ..... B65H/7/04
JP 09208086 A * 8/1997 ..... B65H/7/04
JP 2002193482 A * 7/2002 ..... B65H/7/02

* cited by examiner

*Primary Examiner*—Ren Yan

(57) ABSTRACT

A method in accordance with one embodiment of the present invention includes making a first quantitative measurement, dispensing a number of media sheets from the stack, and making a second quantitative measurement, wherein the quantitative measurement can be, for example, the weight of the stack or the thickness of the stack. A ratio is calculated such that the ratio is equal to the number of sheets dispensed divided by the difference in the first and second quantitative measurements. The ratio can then be multiplied by the second quantitative measurement to establish an estimated number of media sheets remaining in the stack at the time the second quantitative measurement was made.

14 Claims, 5 Drawing Sheets

METHODS AND APPARATUS FOR DISPENSING MEDIA SHEETS FROM A MEDIA STACK

BACKGROUND

Apparatus and methods for automatically dispensing imaging media (such as paper and the like) are known in the art. Such automatic imaging media dispensing apparatus and methods are commonly employed in conjunction with various types of media processing devices. Such media processing devices include imaging devices such as printers, scanners, photocopiers, facsimile machines, and the like.

Conventional media dispensing apparatus typically include at least a media support device and a media picking device. The support device is generally configured to support a stack of media sheets while individual sheets are picked, or dispensed, from the stack. One example of a support device is known as a "paper tray." The picking device is generally configured to successively dispense single media sheets from the media stack. The picking device and the support device of a given media dispensing apparatus are generally configured to operate in conjunction with one another and can also be integral with one another.

Printers, as well as other forms of apparatus which employ media dispensing apparatus, generally also include a media path. The media path is generally defined by a series of drive rollers, guides, and the like, that are configured to operate so as to move individual sheets of media along the media path. The media path is configured to convey one or more successive media sheets from the picking device and through any of a number of various types of processing apparatus.

In a typical electrophotographic printer, such processing apparatus can include, for example, an image-forming apparatus as well as a fusing apparatus. A typical image-forming apparatus is generally configured to form an image from an imaging substance, such as toner or the like, and to deposit the toner onto a media sheet. A typical fusing apparatus is generally configured to affix, or bond, respective images to the media sheets by way of applying heat energy thereto. Another type of processing apparatus typically employed in conjunction with a media path and a media dispensing apparatus is a scanning apparatus, such as in the case of a photocopier.

At least in some instances, such as in the case of printers, it is desirable to provide the printer controller, or processor, with data indicative of the status of the media supply. That is, it is often desirable for the printer "brain" to know how many media sheets remain in the media stack at any given time. Such data can be useful, for example, in accurately predicting whether a certain print job can be completed before the media stack is totally depleted. Generally, a relatively high degree of accuracy is desired in estimating the status of the media supply.

Known methods of estimating the status of the media supply include the use of relatively sophisticated measuring devices that are configured to measure the number of media sheets remaining in the stack at a given point in time in a relatively accurate manner. However, several detriments can be associated with the employment of such known methods, which include reliability issues as well as initial expense, complexity, and maintenance costs.

Therefore, it can be desirable to provide a means of estimating the supply status of a stack of media to be dispensed in a media processing device, wherein such means achieve the benefits to be derived from similar prior art apparatus and methods, but which avoid the shortcomings and detriments individually associated therewith.

SUMMARY

In accordance with various embodiments of the present invention, methods and apparatus for dispensing media sheets from a media stack are disclosed. An apparatus in accordance with one embodiment of the present invention includes a means for supporting a stack of media sheets while individual media sheets are dispensed therefrom. Also included are means for dispensing the media sheets from the stack as well as means for generating count data indicative of how many media sheets are dispensed from the stack during a given period of time. A means for generating measurement data is also included in the apparatus, wherein the measurement data is indicative of a quantitative characteristic of the stack. The apparatus can also include a means for computing an estimated number of media sheets remaining in the stack based on the count data and the measurement data.

A method in accordance with one embodiment of the present invention generally includes procedures and/or acts that can be employed for estimating the number of media sheets remaining in the stack based on the count data and measurement data as can be accomplished by the apparatus mentioned above. For example, a first quantitative measurement of the stack can be obtained, and at least one sheet of media can be dispensed from the stack before obtaining a second quantitative measurement of the stack. A difference can be established by subtracting the second quantitative measurement from the first quantitative measurement. A ratio can then established by dividing the number of media sheets dispensed between the two measurements by the amount of the difference. The difference can be a difference in the weight of the stack. Alternatively, the difference can be a difference in the height, or thickness, of the stack. An estimated quantity of media sheets remaining in the stack can then be established by multiplying the ratio by a final quantitative measurement, which can be the same as the second quantitative measurement.

DETAILED DESCRIPTION

The present invention generally includes apparatus and methods for dispensing media sheets from a stack of media sheets. Specifically, the apparatus and/or methods in accordance with the various embodiments of the present invention can be employed to estimate how many media sheets are left in the stack after a number of media sheets are dispensed from the stack. The estimate can be established in conjunction with the process of dispensing media sheets from the stack by obtaining a first quantitative measurement of the stack, then dispensing a known number of media sheets from the stack, and then obtaining a second quantitative measurement of the stack.

The quantitative measurements can be measurements of any characteristic of the stack that is indicative of the relative quantity of media sheets in the stack. For example, the quantitative measurement can be the weight of the stack, or it can be the height, or thickness, or the stack. A ratio can then be calculated, which ratio is equal to the number of media sheets dispensed divided by the change, or difference, in the two quantitative measurements. The ratio can then be multiplied by a given quantitative measurement to obtain the estimated number of media sheets remaining in the stack at the moment the given quantitative measurement is made. The estimate of the number of media sheets remaining in the stack can be useful for several purposes as is explained in the discussion below.

Figure 1:
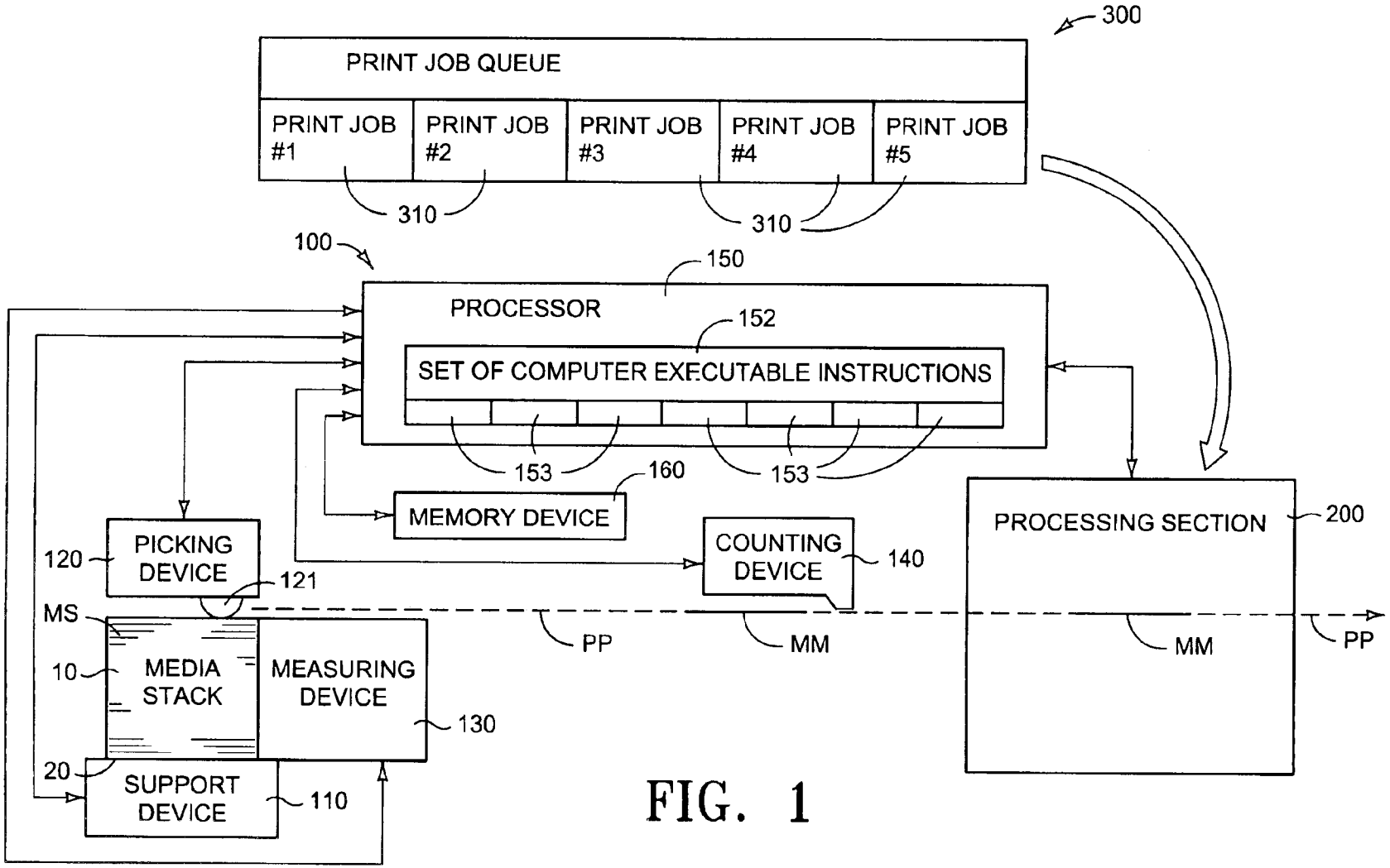
FIG. 1 is a schematic diagram in which a media dispensing apparatus is depicted in accordance with one embodiment of the present invention.

Turning to FIG. 1, a schematic diagram is shown in which a media dispensing apparatus 100 is depicted in accordance with one embodiment of the present invention. As is seen, the apparatus 100 is generally configured to dispense individual media sheets MM from a stack MS of media sheets. Once dispensed from the stack MS, the individual media sheets MM can then be moved along a media path PP in the direction indicated.

Media paths PP are known in the art. Such media paths PP can be defined by any of a number of various known media sheet handling and conveyance devices such as rollers, guides and the like which are not specifically depicted in the interest of clarity, but which are commonly employed to move media sheets MM from one point to another.

As is further shown, the media path PP can be configured to convey the individual media sheets MM to and/or through a processing section 200. The processing section 200 can be any of a number of known devices that are configured to perform a given process in conjunction with the media sheets MM. For example, the processing section 200 can be an imaging device that is configured to form various predetermined images from an imaging substance, such as toner or ink, and that can be further configured to deposit and/or affix the images to the media sheets MM. The media dispensing apparatus 100 and the processing section 200 can be integral with one another. In the alternative, the media dispensing apparatus 100 and the processing section 200 can be separate from one another.

The media dispensing apparatus 100 can include a media support device 110 that is adapted to support the media stack MS (a stack of media sheets MM) thereon. The support device 110 is discussed in greater detail below. The apparatus 100 can also include a picking device 120. The picking device 120 is configured to dispense individual media sheets MM from the media stack MS ("stack") in succession. That is, the picking device 120 is configured to "pull" or "draw" individual media sheets MM from the stack MS in succession while leaving the remainder of the stack intact.

Various forms and configurations of picking devices, such as the picking device 120, are known in the art. The picking device 120 can include a pick roller 121. Pick rollers 121 are also known in the art. As is seen, the stack MS can have a top 10 and an opposite bottom 20. The bottom 20 of the stack MS can contact the support device 110 as the stack is supported thereon. The picking device 120, and in particular the pick roller 121, can contact the top 10 of the stack MS so as to dispense individual media sheets MM therefrom.

Generally, as can be appreciated, individual media sheets MM can be selectively dispensed from the stack MS, until the stack is depleted. That is, as individual media sheets MM are dispensed from the stack MS, the size of the stack becomes smaller as fewer and fewer media sheets are left in the stack. Ultimately, the life of the stack MS ends when either the stack is completely depleted, or additional media sheets MM are added to form a new stack.

That is, a "stack" is defined as a stack of media sheets to which additional media sheets have not been added after commencement of dispensation of media sheets from the stack. In other words, the size of a stack MS for the purposes herein can only diminish and cannot grow or increase. Stated yet another way, whenever media sheets are added to a given stack MS, then the life of the given stack is over and a new stack is formed.

In any case, in order to enable the picking device 120 to function, the bottom 20 of the stack MS can generally be moved closer and closer to the picking device as the stack is depleted. That is, in order for the picking device 120 to remain in contact with the top 10 of the stack MS as the stack is depleted, the bottom 20 of the stack can be made to approach the picking device. Such movement of the bottom 20 of the stack MS closer to the picking device 120 as the stack is depleted can be accomplished in any of a number of known manners.

For example, the picking device 120 can be configured to move toward the support device 110 as the stack MS is depleted while the support device remains substantially stationary. Alternatively, the support device 110 can be configured to move the bottom 20 of the stack MS toward the picking device 120 as the stack is depleted, wherein the picking device remains substantially stationary. The latter case can prove advantageous in that the picking device 120 does not move substantially relative to the media path PP, and thus, the transition of media sheets from the top of the stack to the media path is simplified.

Still referring to FIG. 1, the apparatus 100 can further include a measuring device 130. The measuring device 130 is configured to detect measurement data indicative of a quantitative characteristic of the stack MS. That is, the measuring device 130 is adapted to detect and measure a quantitative characteristic of the stack MS. The term "quantitative characteristic" as used herein is defined as any characteristic of the stack MS that can be measured and that is indicative of the relative number of media sheets MM remaining in the stack.

For example, a quantitative characteristic of the stack MS can be the "height" or "thickness" of the stack. That is, as can be appreciated, the thickness, or height, of the stack MS can be measured and will decrease proportionally to the number of media sheets MM remaining in the stack as the stack is depleted. As another example, a quantitative characteristic of the stack MS can be the "weight" or "mass" of the stack. That is, the weight, or mass, of the stack MS can also be measured and will decrease proportionally to the number of media sheets MM remaining in the stack as the stack is depleted.

Thus, the measuring device 130 can be configured to detect and measure the thickness, or height, of the stack MS.

Furthermore, the measuring device 130 can alternatively be configured to detect the weight, or mass, of the media stack MS. It is understood that the measuring device 130 is not intended to be limited to configurations which are specifically shown and described herein.

That is, the measuring device 130 is not intended to be limited to configurations in accordance with which only the thickness and/or the weight of the media stack MS can be detected. In other words, it is understood that the measuring device 130 can be configured, in accordance with alternative embodiments of the present invention, to detect quantitative characteristics of the stack MS other than those of thickness and weight.

Figure 2:
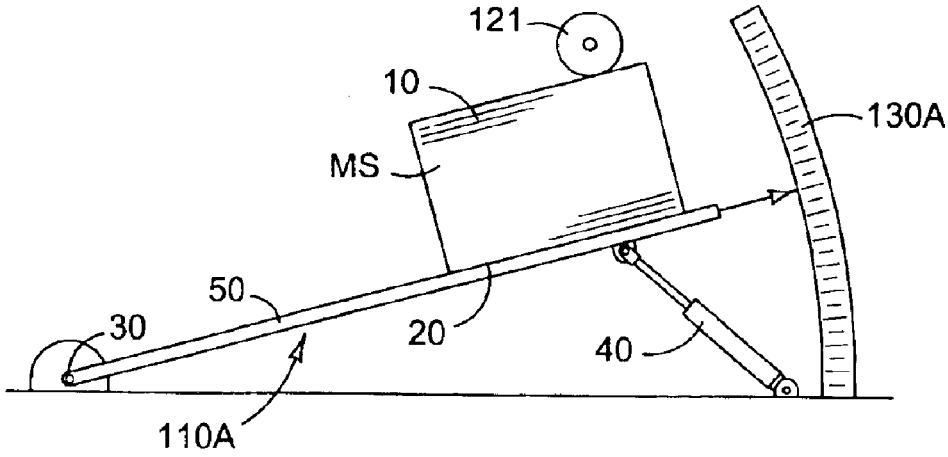
FIG. 2 is a side elevation view in which an alternative configuration of the support device and measuring device of the apparatus of FIG. 1 are depicted.
Figure 3:
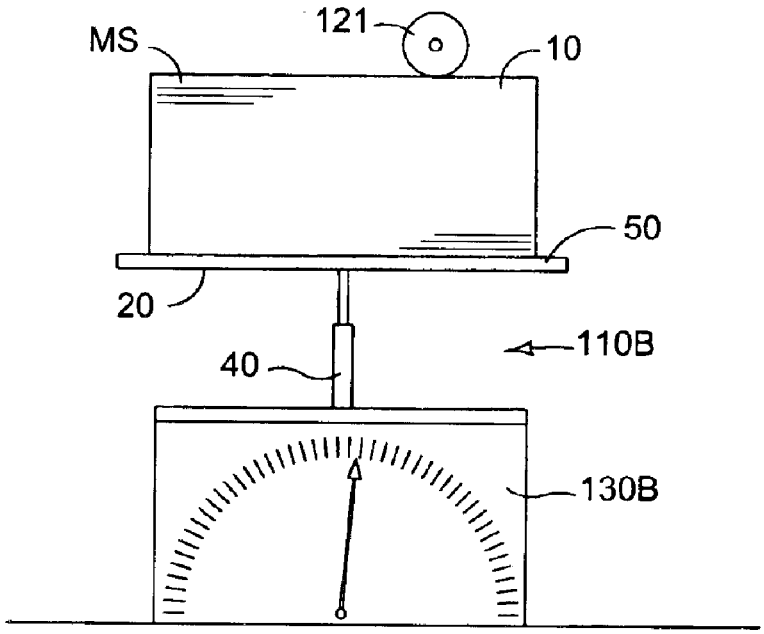
FIG. 3 is a side elevation view in which another alternative configuration of the support device and measuring device of the apparatus of FIG. 1 are depicted.

Turning briefly to FIGS. 2 and 3, side elevation views are shown therein in which two alternative configurations of the support device 110 and measuring device 130 are depicted, respectively. Specifically, first alternative configurations of a support device 110A and a measuring device 130A are depicted in FIG. 2. As is seen, the support device 110A can include a platform 50 on which the media stack MS can be supported so as to remain in contact with the pick roller 121 as the stack is depleted. As is also seen, the platform 50 can be configured to pivot about a pivot point 30.

With further reference to FIG. 2, the support device 110A can include a lift mechanism 40 that is adapted to lift the stack bottom 20 toward the pick roller 121 as the stack MS is depleted. The lift mechanism 40 can be operatively connected with the platform 50, wherein the lift mechanism is adapted to move the platform toward the pick roller 121 as the stack MS is depleted due to dispensation of media sheets MM therefrom.

Furthermore, the measuring device 130A can be in the form of a thickness detector as shown that is configured to detect and measure the thickness of the stack MS as the stack is depleted. That is, the measuring device 130A can be adapted to substantially detect a position of the stack bottom 20 relative to the pick roller 121. It is understood that the support device 110A and the measuring device 130A can be incorporated into a single unit.

Moving briefly to FIG. 3, second alternative configurations of a support device 110B and a measuring device 130B are depicted. As is seen, the support device 110B can include a platform 50 on which the media stack MS can be supported so as to remain in contact with the pick roller 121 as the stack is depleted. The support device 110 can also include a lift mechanism 40 that is configured to move the platform 50 toward the pick roller 121, and thus to move the stack bottom 20 toward the pick roller.

Furthermore, it is seen that the measuring device 130B can be substantially in the form of a weight detector such as a scale or the like. The scale can be an electronic scale, configured to generate an electrical signal in response to sensing and/or detecting the weight of the media stack MS. The lift mechanism 40 can be supported on the measuring device 130B as is shown. Alternatively, the measuring device 130B can be supported on the lift mechanism 40, wherein the platform 20 is supported directly by the measuring device.

It is understood that the views shown in FIGS. 2 and 3 are intended to provide only basic principles of operation of various alternative configurations of the support device 110 and the measuring device 130, and that such principles can be implemented by way of any of a number of various known means. It is further understood that the support device 130, in any of its various possible specific configurations, can be configured as an accessible tray or the like (not shown). Such accessible trays are known and widely employed in the art, and are configured to open and close in order to allow a user to form a new media stack by adding additional media sheets to the support device. For example, such media trays are commonly configured to open and close in the manner of a drawer.

Thus, for example, when the stack MS becomes low or completely depleted, a user can then open the accessible tray and insert additional media sheets onto the support device to form a new stack thereon. In such a configuration of an accessible tray, the support device 130 can also include a sensor (not shown) that is adapted to detect if the tray is open or closed, the significance of which becomes more apparent in later discussion.

Turning back to FIG. 1, the apparatus 100 can also include a counting device 140. The counting device 140 is configured to generate count data indicative of the number of media sheets MM that are dispensed from the stack MS during a given time period. That is, the counting device 140 is configured to detect and count, or keep track of, how many media sheets MM are dispensed from the stack MS between a first event and a second event.

Counting devices are generally known in the art, and the counting device 140 can have any of a number of known forms. For example, the counting device 140 can be a top-of-form detector that is configured to detect and count the number of media sheets MM that pass a given point on the media path PP downstream of the picking device 120. Top-of-form detectors are known and are widely employed in various devices that are configured to process media sheets such as the media sheets MM.

The apparatus 100 can also include a processor 150. The processor 150 can have any of a number of known forms including programmable logic computers, processing "chips," and the like. The processor 150 is configured to execute a set of computer executable instructions 152 to thus enable the processor to perform computations and to make decisions based thereupon. The set of computer executable instructions 152 can include a plurality of individual computer executable steps 153.

The apparatus 100 can also include a memory device 160 that is adapted to store data therein, which data is retrievable by the processor 150. For example, the memory device 160 can be adapted to store the set of computer executable steps therein for access by the processor 150. Memory devices are known in the art and can include, for example, a semiconductor memory device.

As is depicted, the processor 150 can be in data-communicative linkage with one or more of the support device 110, the picking device 120, the measuring device 130, the counting device 140, and the memory device 160. The term "data-communicative linkage" as used herein is defined as being connected so as to allow the transmission of data signals to and/or from.

As is also shown in FIG. 1, the processor 150 can be in data-communicative linkage with the processing section 200. Furthermore, the processor 150 can be configured to perform controlling functions with regard to any processes to be carried out by the processing section 200. That is, for example, in the case wherein the processing section 200 is an imaging section, the processor 150 can be configured to control the imaging process to be carried out by the processing section.

More specifically, in the case wherein the processing section 200 is an imaging section, the processor 150 can be configured to control the execution of a print job queue 300 by the processing section. The print job queue 300 can include a plurality of individual print jobs 310. Each print job 310 can be, for example, a separate document or the like. However, regardless of whether the processor 150 is configured to control the operation of the processing section 200, the set of computer executable instructions 152 can be operatively resident within the memory device 160 and executable by the processor.

Furthermore, the set of computer executable instructions 152 can be adapted to cause the processor 150 to compute an estimated number of media sheets remaining in the stack MS based on the count data and the measurement data. That is, the set of computer executable instructions 152 can be configured to cause the processor 150 to compute an estimated number of media sheets MM remaining in the stack MS based on data detected by the counting device 140 and the measuring device 130.

More specifically, the set of computer executable instructions 152 can be adapted to cause the processor 150 to compute an estimated number of media sheets MM remaining in the stack MS based on a change in a quantitative measurement of the stack MS and a corresponding number of media sheets MM that are dispensed from the stack, wherein the dispensation of the corresponding number of media sheets from the stack results in the change in the quantitative measurement. Such a computation of the estimated number of media sheets MM remaining in the stack MS is explained in greater detail below.

It is understood that, although not depicted, the apparatus 100 can include any number of additional elements and/or devices. For example, the apparatus 100 can include a chassis (not shown) on which any of the aforementioned components can be supported. Furthermore, an enclosure (not shown) can be provided to enclose one or more of the aforementioned devices. It is further understood that up to and including all of the aforementioned devices and components can be combined and/or incorporated into a single unitary apparatus.

Figure 4:
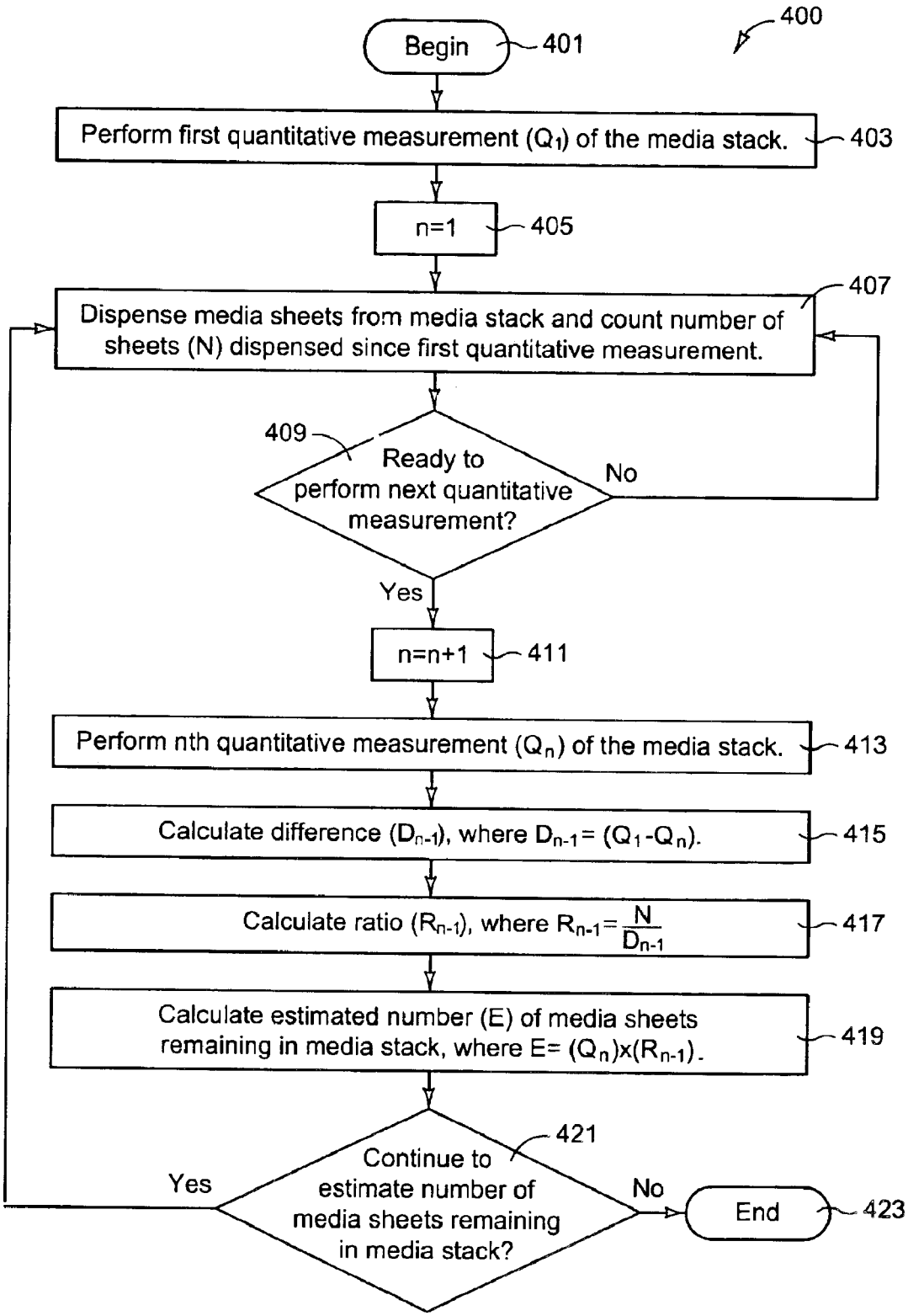
FIG. 4 is a flow diagram that depicts an operational sequence that can be employed to operate the apparatus shown in FIG. 1.

With reference now to FIG. 4, a flow diagram is shown in which an operational sequence 400 is depicted. The operational sequence 400 generally illustrates a basic method of obtaining an estimated number of media sheets in a stack of media sheets in accordance with various embodiments of the present invention, wherein such a method can be employed by the apparatus 100 depicted in FIG. 1 and which is described briefly above.

Still referring to FIG. 4, from the beginning 401 of the operational sequence 400, the sequence proceeds next to step 403. In accordance with step 403, a first quantitative measurement is performed on the stack of media sheets. That is, in accordance with step 403, a first value for a quantitative measurement of the stack is obtained. The first measurement of the quantitative characteristic can be an initial measurement of the stack before any media sheets are dispensed therefrom. Alternatively, the first quantitative measurement can be performed at any time after dispensation of media sheets from the stack is commenced.

As is discussed above, the quantitative characteristic can be any characteristic that can be measured and that gives a relative indication of the quantity of media sheets in the stack. For example, as is also mentioned above, the quantitative characteristic can be the thickness, or height, of the stack. Alternatively, the quantitative characteristic can be the weight, or mass, of the stack.

The value of the quantitative characteristic measurement can be represented by "$Q_n$," where "n" refers to the nth measurement. Thus, the first value obtained by the first measurement of the quantitative characteristic can be represented by "$Q_1$." It can be appreciated that the measuring device 130 can be employed to perform measurements of the quantitative characteristics, as is explained above with reference to FIG. 1.

Proceeding from step 403 to step 405, a counter is initiated, wherein n=1. The significance of this becomes apparent in the discussion below. From step 405, the sequence 400 moves to step 407 in accordance with which at least one individual media sheet is dispensed from the media stack. Furthermore, in accordance with step 407, the number of media sheets dispensed from the stack is counted from the time at which the first quantitative measurement is made.

That is, in accordance with step 407, after the first quantitative measurement of the stack is made, individual media sheets are dispensed from the media stack and are counted. The number of media sheets counted since the first quantitative measurement is made can be represented by "N." The process of dispensing individual media sheets from the stack can be accomplished by the picking device 120 as is described above with reference to FIG. 1. As is also discussed above with reference to FIG. 1, the process of counting the number of media sheets dispensed since the first quantitative measurement is obtained can be accomplished by the counting device 140.

With continued reference to FIG. 4, the next step in the sequence 400 is that of step 409. As is seen, step 409 is a query that asks if the next quantitative measurement should be performed, or obtained. That is, step 409 asks whether the next quantitative measurement $Q_2$ should be obtained. The resolution of the query of step 409 can be based on any of a number of criteria.

For example, the answer to the query of step 409 can be based on elapsed time. More specifically, the value of the second measurement ($Q_2$) of the quantitative characteristic can be performed after a predetermined period of time has elapsed from a predefined event. As yet a more specific example, the value of the second measurement can be performed at the expiration of a predetermined period of time, which period of time commences when the first value ($Q_1$) of the quantitative measurement is obtained.

As yet a further example, the second measurement of the quantitative characteristic can be performed after a predetermined number of media sheets have been dispensed from the media stack. As yet still another example, the second quantitative measurement can be a predetermined set point. That is, the measuring device 130 (shown in FIG. 1) can be configured to transmit a signal when the quantitative characteristic reaches a given predetermined value. More specifically, for example, the measuring device 130 can be configured to transmit a data signal to the processor at the moment the media stack MS (shown in FIG. 1) reaches a predefined height.

In any case, if the answer to the query of step 409 is "no," then the sequence 400 returns to step 407 in accordance with which the dispensing and counting of individual media sheets continues. However, if the answer to the query of step 409 is "yes," then the sequence 400 proceeds to step 411 which causes the counter to increment. From step 411, the sequence 400 proceeds to step 413 in accordance with which the "nth" quantitative measurement is obtained.

From step 413, the sequence 400 moves to step 415. In accordance with step 415, a difference $D_{n-1}$ is computed.

More specifically, in accordance with step 415, the difference $D_{n-1}$ is computed, wherein $D_{n-1}=(Q_1-Q_n)$. Thus, the first difference $D_1$ is equal to the difference between the first quantitative measurement $Q_1$, and the second quantitative measurement $Q_2$. The computation of the difference $D_{n-1}$ can be performed by the processor 150 in conjunction with the set of computer executable instructions 152 (both shown in FIG. 1). The significance of the difference $D_{n-1}$ becomes apparent in the following discussion.

Still referring to FIG. 4, the sequence 400 proceeds from step 415 to step 417. In accordance with step 417, a ratio $R_{n-1}$ is computed, wherein $R_{n-1}=(N/D_{n-1})$. It is understood that "N" is the number of media sheets that are dispensed from the stack after the first quantitative measurement is obtained, and up until the nth quantitative measurement is obtained. That is, "N" is the number of media sheets that are dispensed from the media stack between the first quantitative measurement and the nth quantitative measurement.

Thus, as is indicated by the equation, $R_{n-1}=(N/D_{n-1})$, the ratio is equal to a given number of media sheets dispensed from the stack to a change in the quantitative characteristic of the stack, wherein the change in the quantitative characteristic corresponds to the given number of media sheets. That is, for example, the first ratio is equal to the number of media sheets dispensed between the first and second quantitative measurements divided by the difference between the first and second quantitative measurements.

From step 417, the sequence 400 moves to step 419. In accordance with step 419, the estimated number ("E") of media sheets remaining in the stack is calculated. That is, $E=(Q_n)\times(R_{n-1})$. In other words, $E=(Q_n)\times[N/(Q_1-Q_n)]$. Thus, in summary, the estimated number of media sheets remaining in the stack can be computed by first obtaining a first measurement of the quantitative characteristic and then obtaining a second measurement of the quantitative characteristic while counting the number of media sheets that are dispensed from the stack between the two measurements.

Thereafter a ratio is computed, wherein the ratio is the number of media sheets counted divided by the difference in the first and second quantitative measurements. The ratio is then multiplied by the second quantitative measurement to obtain the estimated number of media sheets remaining in the stack. It is understood that the sequence 400 depicts a specific example of a method in accordance with one embodiment of the present invention. That is, specifically, in accordance with the sequence 400, the method of estimating the number of media sheets remaining in the stack always employs the first measurement of the quantitative characteristic.

However, it can be appreciated that the method depicted by the sequence 400 can be modified slightly, wherein any two measurements of the quantitative characteristic can be employed to compute an estimated number of media sheets in the stack. It can also be appreciated that, as the number of media sheets dispensed ("N") between two associated measurements of the quantitative characteristic increases, the accuracy of the estimation of the number of media sheets in the stack generally increases. Therefore, it can be advantageous to obtain the first quantitative measurement before, or shortly after, the commencement of dispensation of media sheets from the stack.

From step 419, the sequence 400 proceeds to step 421 that is another query. The query of step 421 asks whether another estimation of the number of media sheets in the stack is to be computed. The answer to the query of step 421 can depend upon any of a number of criteria. For example, the answer to the query of step 421 can depend upon the last estimate of the number of media sheets in the stack. More specifically, for example, a predetermined number of media sheets can be established, wherein if the estimated number of media sheets in the stack is below the predetermined number, then no additional estimations are to be performed.

In any case, if the answer to the query of step 421 is "yes," then the sequence 400 proceeds to step 407, in accordance with which additional media sheets are dispensed from the media stack and are counted as they are dispensed. On the other hand, if the answer to the query of step 421 is "no," then the sequence 400 proceeds to the end 423.

Figure 5:
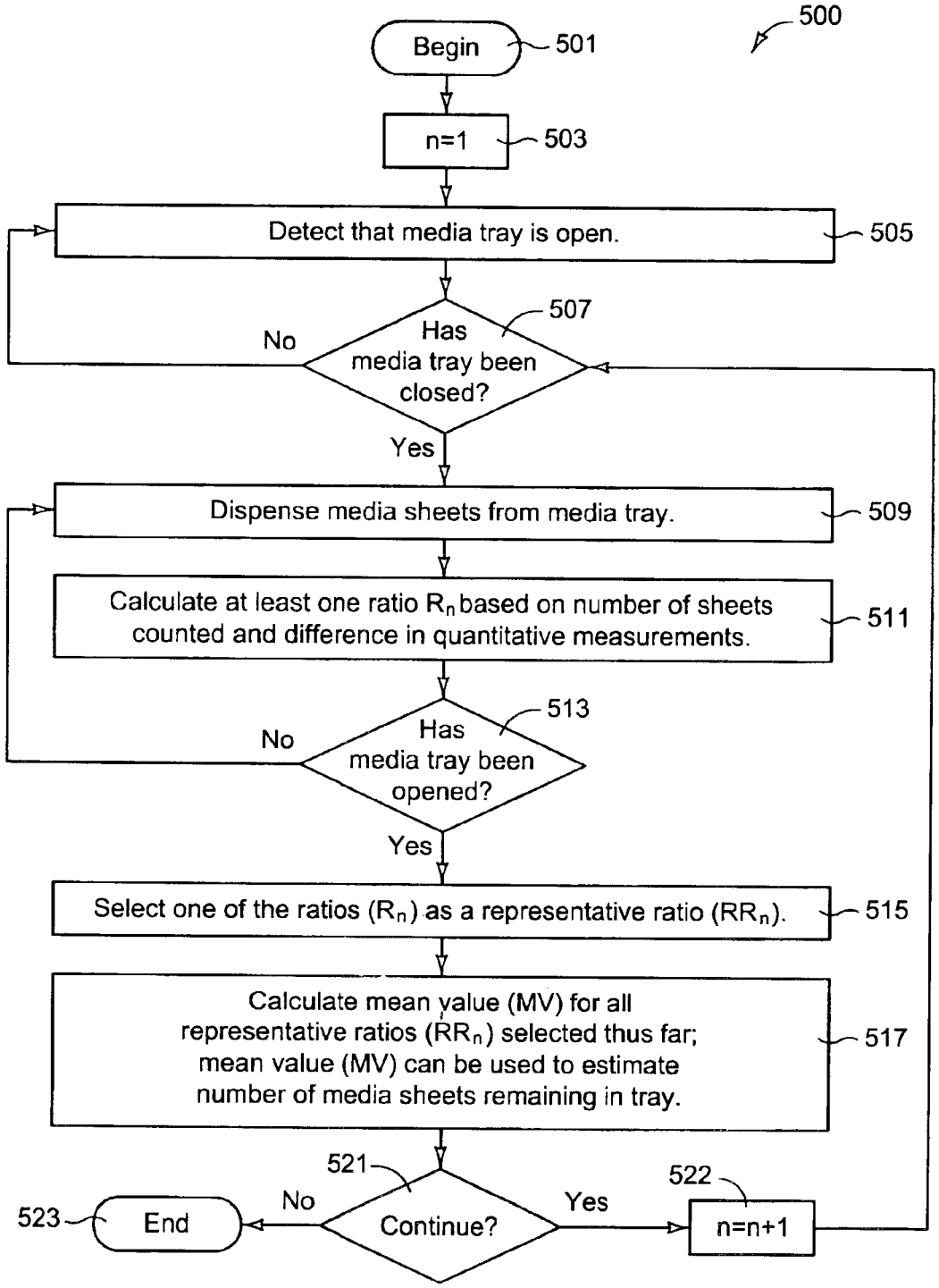
FIG. 5 is another flow diagram that depicts another operational sequence that can be employed to operate the apparatus shown in FIG. 1.

Moving now to FIG. 5, a flow diagram is shown in which another operational sequence 500 is depicted. It is understood that the operational sequence 500 can be accomplished by the apparatus 100 that is described above and shown in FIG. 1. Basically, the operational sequence 500 describes a method of employing several ratios such as the ratio described above with reference to FIG. 4, wherein the several ratios can be employed to generally increase the accuracy with which an estimation of the number of media sheets remaining in the stack can be performed.

Still referring to FIG. 5, the operational sequence 500 proceeds from the beginning 501 to step 503 in accordance with which a counter is initiated. From step 503, the sequence 500 moves to step 505. At step 505, the media tray is detected to be open. That is, in accordance with step 505, the support device 110 (shown in FIG. 1) is detected to be accessible by a user. In that case, it can be assumed that media sheets can be added to the media stack supported on the support device, or media tray.

From step 505, the sequence 500 proceeds to step 507 which is a query. The query of step 507 asks if the media tray has been closed. While the media tray remains open, the sequence 500 remains in a loop through steps 505 and 507. That is, if the answer to the query of step 507 is "no," then the sequence returns to step 505.

However, when the media tray is detected to have been closed, the answer to the query of step 507 is "yes." In that case, the sequence 500 proceeds from step 507 to step 509. It is understood that when the media tray has been closed, it can be assumed that the tray is no longer accessible to any user. In accordance with step 509, dispensation by the picking device 120 (shown in FIG. 1) of media sheets from the media stack which is supported on the support device, or media tray, is commenced.

From step 509, the sequence 500 proceeds to step 511. Step 511 dictates that at least one ratio $R_n$, wherein "n" references the "nth media stack." That is, for example, one or more ratios $R_1$ can be calculated for a first stack, and one or more ratios $R_2$ can be calculated for a second stack, and so on. It is understood that the term "stack" as used herein refers to a stack of media sheets, wherein no media sheets are added to the stack after the stack is placed on the support device, and wherein dispensation of media sheets from the stack has commenced.

Furthermore, it is understood that the ratio $R_n$ is calculated based on both the number of media sheets counted by the counting device 140 (shown in FIG. 1) and the difference in the corresponding quantitative measurements obtained via the measuring device 130 (also shown in FIG. 1). It can be recalled that a method of computing such a ratio in accordance with one embodiment of the present invention is explained above with reference to the operational sequence 400 shown in FIG. 4. Furthermore, it can be appreciated that various data, such as the count data and the ratios which are generated in accordance with the various procedures of the sequence 500, can be stored in the memory device 160 (shown in FIG. 1) for later recall.

The sequence 500 proceeds from step 511 to step 513, which is a query. The query of step 513 asks whether the media tray has been opened. In other words, the query of step 513 asks whether the support device 110 (shown in FIG. 1) has been rendered accessible to a user such that the user is able to add media to the support device to form a new stack. If the answer is "no," then the sequence 500 returns to step 509 in accordance with which the process of dispensing media sheets from the nth stack continues. Furthermore, additional ratios can be calculated for the nth stack in accordance with step 511.

When the media tray is opened, then the answer to the query of step 513 is "yes," and the sequence 500 proceeds to step 515. It is understood that when the media tray is opened, it can be assumed that additional media sheets are added thereto in order to form a new stack. Thus, when the media tray is detected to have been opened, it can be assumed that the life of the nth stack has ended and a new stack has been formed.

Accordingly, step 515 dictates that a representative ratio of the nth stack is selected. A "representative ratio" of the nth stack can be, for example, a ratio of the nth stack that is considered to be the most accurate of the ratios calculated for the nth stack. More specifically, for example, if the method described above with reference to the sequence 400 shown in FIG. 4 is employed to compute the ratios for the nth stack, then the last ratio computed can generally be considered to be the most accurate ratio. Thus, in such a case, the last ratio computed for the nth stack before the media tray is detected to have been opened can be selected as the representative ratio of the nth stack $RR_n$. The representative ratio for the nth stack can then be stored in the memory device 160 (shown in FIG. 1) for later recall.

From step 515, the sequence 500 proceeds to step 517. In accordance with step 517, a mean value (MV) can be computed for all representative ratios calculated thus far. That is, as additional representative ratios are obtained for each of an increasing number of stacks, the mean value can be updated by including each new representative value in a recalculation thereof.

For example, for the representative ratio of the first stack, the mean value is the same as the representative value for a first stack, since there is only one representative ratio. After the representative ratio of a second stack is obtained, the mean value is updated and is equal to the average of the representative ratios of the first stack and the second stack, respectively. Furthermore, after the representative ratio of a third stack is obtained, the mean value is updated and recalculated to be equal to the average of the representative ratios of the first stack, the second stack, and the third stack, respectively.

It is understood that the step 517, in accordance with an alternative embodiment of the method illustrated by the sequence 500, can dictate that the median value for all representative ratios is determined, rather than the mean value. Also, as is indicated by step 517, the mean value (or median value) can be used to compute the number of media sheets remaining in a given stack. Furthermore, the utilization of the mean value (or median value) to compute the number of media sheets remaining in a given stack can be independent of the sequence 500. That is, step 517 need not include the utilization of the mean value (or median value) to compute the number of media sheets remaining in a given media stack as an integral part of the sequence 500.

As a more specific explanation of the step 517, and as is discussed above with reference to the operational sequence 400 shown in FIG. 4, the number of media sheets remaining in a given stack can be computed by multiplying a ratio (the determination of which is discussed above) by a given value of a measurement of the quantitative characteristic. However, the number of sheets remaining in a given stack can alternatively be computed by multiplying the mean value (or median value) by a given value of a measurement of the quantitative characteristic.

With continued reference to FIG. 5, the sequence 500 proceeds from step 517 to step 521, which is another query. The query of step 521 asks whether the process of determining the mean value (or median value) should be continued. If the answer to the query of step 521 is "yes," then the sequence 500 moves to step 522 in accordance with which the counter is incremented. From step 522, the sequence 500 returns to step 507 which queries whether the media tray has been closed. On the other hand, if the answer to the query of step 521 is "no," then the sequence 500 ends at 523.

Figure 6:
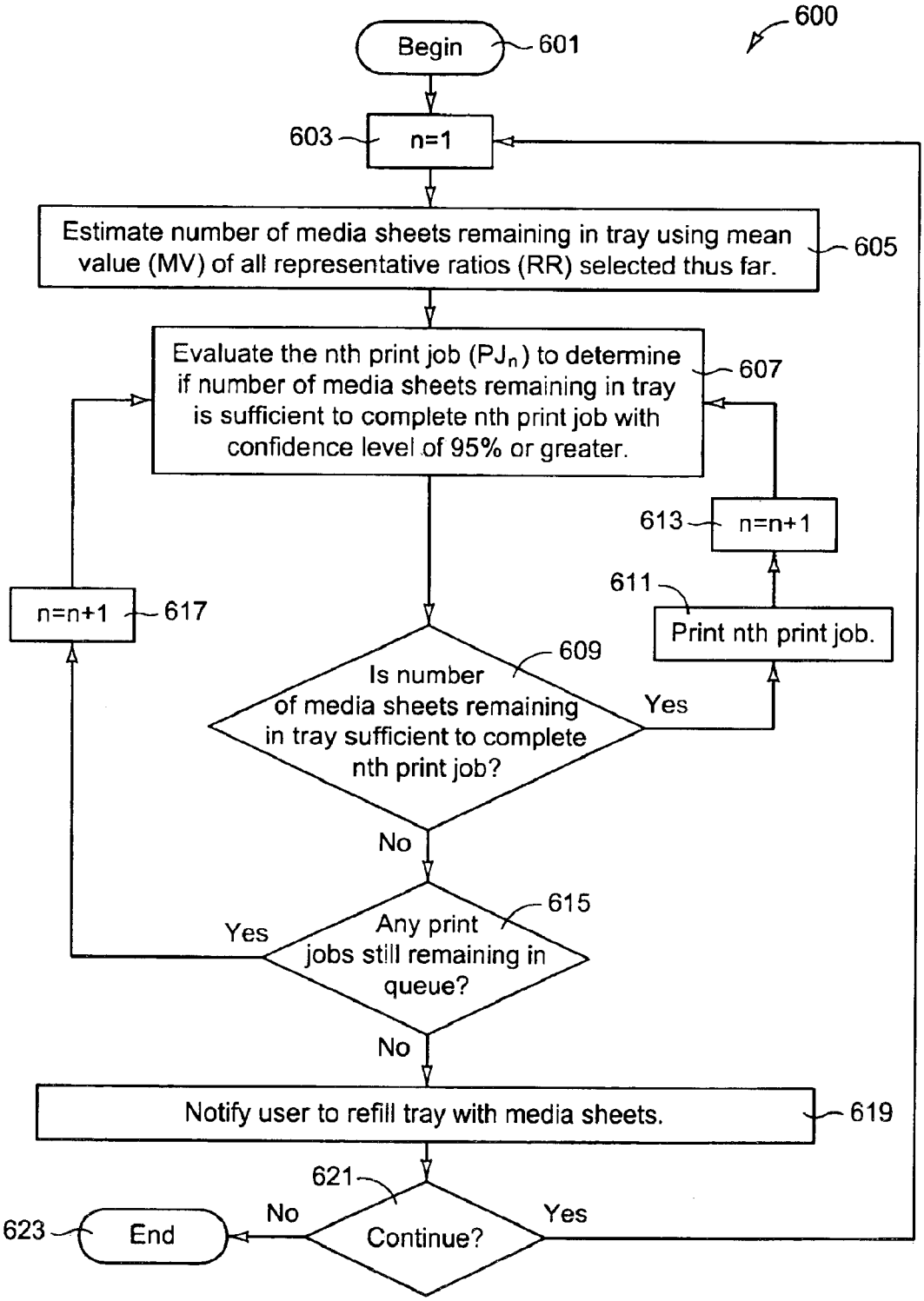
FIG. 6 is another flow diagram that depicts yet another operational sequence that can be employed to operate the apparatus shown in FIG. 1.

Turning now to FIG. 6, yet another flow diagram is shown in which yet another operational sequence 600 is depicted. The operational sequence 600 generally represents a method in accordance with one embodiment of the present invention for employing a mean value (or median value), as is explained above with respect to the operational sequence 500 shown in FIG. 5, to process a plurality of print jobs.

The operational sequence 600 begins at 601 and proceeds to step 603 in accordance with which a counter is initialized, wherein n=1. From step 603, the sequence 600 proceeds to step 605. In accordance with step 605, the number of media sheets remaining in a given stack can be estimated by employing the mean value (or median value) as is explained above with respect to step 519 of the sequence 500, and which is shown in FIG. 5.

From step 605, the sequence 600 moves to step 607. In accordance with step 607, the nth print job in a queue of print jobs is evaluated to determine if there is sufficient media in the media tray to complete the nth print job. This can be accomplished by the set of computer executable instructions 152 (shown in FIG. 1) in conjunction with the processor 150 (also shown in FIG. 1), wherein the number of pages in the nth print job is determined.

That is, the nth print job can be examined to determine the number of pages required to complete the nth print job. This number can then be compared to the estimated number of media sheets remaining in the tray as is computed in step 605 and which is explained above in detail with respect to step 519 of the sequence 500 shown in FIG. 5.

Still referring to FIG. 6, various known statistical methods can be employed by the set of computer executable instructions 152 to determine, within a predetermined confidence level, whether a sufficient quantity of media sheets remain in the tray to complete the nth print job. For example, as indicated, the confidence level can be selected to be 95% or greater.

Moving on from step 607 to step 609, a query asks if there is a sufficient quantity of media sheets remaining in the media tray to complete the nth print job. If the answer to the query of step 609 is "yes," then the sequence 600 proceeds from step 609 to step 611 in accordance with which the nth print job is printed. From step 609, the sequence 600 moves to step 613, wherein the counter is incremented such that n=n+1.

From step 613, the sequence 600 returns to step 607 in accordance with which the next print job is evaluated to determine if the number of media sheets remaining after printing the previous print job is sufficient to complete the next print job. It can be appreciated that, because the number of pages of the previous print job are known, that number can be subtracted from the previous estimated number of media sheets remaining in the stack to result in an updated estimate of the number of media sheets remaining in the stack. Alternatively, however, the sequence 600 can proceed from step 613 to step 605 in accordance with which another estimate of the number of media sheets remaining in the stack is performed.

In any case, if the answer to the query of step 609 is "no," then the sequence 600 proceeds to step 615 which is another query. The query of step 615 asks whether there are any additional print jobs in the print job queue. If there are additional print jobs in the print job queue, then the answer to the query of step 615 is "yes," and the sequence 600 moves to step 617, wherein the counter is incremented such that n=n+1. From step 617, the sequence 600 returns to step 607 in accordance with which the next print job in the print job queue is evaluated to determine if the number of media sheets in the stack is sufficient to print the next print job.

However, if no additional print jobs remain in the print job queue, then the answer to step 615 is "no," and the sequence 600 moves to step 619. In accordance with step 619, a signal is transmitted, wherein the signal notifies the user to refill the media tray with additional media sheets so as to form a new stack. When the media tray is refilled and a new stack is formed in accordance with step 619, the sequence 600 proceeds to step 621 which is yet another query.

The query of step 621 asks whether the process of evaluating print jobs should continue. If the answer to the query of step 621 is "yes," then the sequence 600 returns to step 603 in accordance with which the counter is re-initialized such that n=1 again. However, if the answer to the query of step 621 is "no," then the sequence 600 ends at 623.

Returning now to FIG. 1, it can be appreciated in light of the above discussion with respect to the operational sequence 400 shown in FIG. 4, that the set of computer executable instructions 152 can be adapted to cause the processor 150 to calculate a ratio of a given change in the quantitative characteristic to a corresponding number of media sheets dispensed from the stack.

Furthermore, it can also be appreciated in light of the above discussion with respect to the operational sequence 400 shown in FIG. 4, that the set of computer executable instructions 152 can be further adapted to cause the processor 150 to compute an estimated number of media sheets remaining in the stack MS based on the ratio and a measurement datum indicative of the quantitative characteristic of the stack, wherein the measurement datum is generated by the measuring device 130 as is discussed above.

Still referring to FIG. 1, it can further be appreciated in light of the above discussion with respect to the operational sequence 500 shown in FIG. 5, that the set of computer executable instructions 152 can also be adapted to cause the processor 150 to compute a plurality of ratios, wherein each ratio is a ratio of a respective change in the quantitative characteristic to a respective corresponding number of media sheets dispensed from the stack.

Also, in light of the above discussion with respect to the operational sequence 500 shown in FIG. 5, the set of computer executable instructions 152 can be adapted to cause the processor 150 to calculate a mean value for the plurality of ratios. Furthermore, as is explained above, the set of computer executable instructions 152 can alternatively be adapted to cause the processor 150 to calculate a median value for the plurality of ratios.

In accordance with another embodiment of the present invention, a method of dispensing media sheets from a stack of media sheets includes obtaining a first quantitative measurement of the stack, and obtaining a second quantitative measurement of the stack. Also, the method includes dispensing at least one media sheet from the stack between the time the first measurement is made and the time the second measurement is made.

That is, at least one media sheet is dispensed between the first quantitative measurement and the second quantitative measurement. It is understood that media sheets such as the media sheets MM shown in FIG. 1 can be dispensed in accordance with the method by way of a picking device such as the picking device 120 described above with reference to FIG. 1.

Such quantitative measurements can be obtained in accordance with the method by way of a measuring device such as the measuring device 130 described above with reference to FIG. 1, as well as the measuring devices 130A and 130B described above with reference to FIGS. 2 and 3 respectively. That is, for example, the process of obtaining a quantitative measurement of the stack can include measuring the thickness, or the height, of the stack. Alternatively, for example, the process of obtaining a quantitative measurement of the stack can include weighing the stack, or determining its mass.

The method can also include establishing a difference by subtracting the second quantitative measurement from the first quantitative measurement. Such a calculation of the difference can be performed by a set of computer executable instructions such as the set of computer executable instructions 152 described above with reference to FIG. 1. That is, the computer executable instructions 152 can be adapted to establish the difference in accordance with the method.

Also in accordance with the method, a count is established by counting the media sheets that are dispensed from the stack between the first quantitative measurement and the second quantitative measurement. Such a count can be established by a counting device such as the counting device 140 described above with reference to FIG. 1. That is, the counting device 140 can be adapted to count the number of media sheets MM in accordance with the method.

A ratio is also established in accordance with the method. That is, the method includes establishing a ratio by dividing the count by the difference. The establishment of such a ratio can be performed by way of the set of computer executable instructions 152 in conjunction with the processor 150. Furthermore, examples of establishing the difference, as well as establishing the ratio are discussed above with reference to the operational sequence 400 shown in FIG. 4.

Additionally, the method includes establishing an estimated quantity of media sheets remaining in the stack by multiplying the second quantitative measurement by the ratio. This process of establishing an estimated number of media sheets remaining in the media stack can be performed by the set of computer executable instructions 152 in conjunction with the processor 150. An example of this process is also described above with respect to the operational sequence 400 shown in FIG. 4.

The method can also include determining that the estimated quantity of media sheets remaining in the stack is low. This can be performed in response to establishing the estimated quantity of media sheets remaining in the stack.

That is, for example, a predetermined set point of a given number of media sheets can be defined. If, in accordance with the method, the number of media sheets remaining in the stack is estimated, and that number is determined to be less than the set point, then the determination has been made that the quantity of media sheets remaining in the stack is low. These processes can be performed by the set of computer executable instructions 152 in conjunction with the processor 150.

Furthermore, an "add media" signal can be transmitted in response to determining that the estimated quantity of media sheets remaining in the stack is low. This process can also be performed by the set of computer executable instructions 152 in conjunction with the processor 150. The add media signal can be any signal that can be detected by a user and that can be interpreted as indicating that the quantity of media sheets remaining in the stack is low. For example, the add media signal can be an audible "beep." Alternatively, the add media signal can be a visual flashing light, or the like.

After the first and second quantitative measurements are obtained, a third quantitative measurement of the stack can then be obtained as well. The third quantitative measurement can then be multiplied by the ratio to establish an estimated quantity of media sheets remaining in the stack. In other words, after the first and second quantitative measurements are obtained, and after the associated estimated quantity of media sheets remaining in the stack is established as discussed above, additional media sheets can be dispensed from the stack.

Thus, when additional media sheets are dispensed from the stack after the estimated quantity of media sheets remaining in the stack is established, that quantity becomes inaccurate. Accordingly, the previously established ratio as discussed above can be used along with the third quantitative measurement to establish an updated estimated quantity of media sheets remaining in the stack.

Alternatively, when a third quantitative measurement is established, an updated difference can be established by subtracting the third quantitative measurement from the first quantitative measurement. Similarly, an updated count can be established by counting the number of media sheets that are dispensed from the stack between the first quantitative measurement and the third quantitative measurement. Likewise, an updated ratio can be established by dividing the updated count by the updated difference. Finally, an updated estimated quantity of media sheets remaining in the stack can be established by multiplying the third quantitative measurement by the updated ratio.

As yet another alternative, when a third quantitative measurement is obtained an updated difference can be established by subtracting the third quantitative measurement from the second quantitative measurement. Similarly, an updated count can be established by counting the number of media sheets that are dispensed from the stack between the second quantitative measurement and the third quantitative measurement. An updated ratio can then be established by dividing the updated count by the associated updated difference. An updated estimated quantity of media sheets remaining in the stack can be established by multiplying the third quantitative measurement by the updated ratio.

A proposed print job can be provided in accordance with the method. An evaluation can then be made as to whether the estimated quantity of media sheets remaining in the stack is sufficient to complete the proposed print job. As is discussed above, this evaluation can be made so as to maintain a predetermined minimum level of confidence with regard to whether the estimated quantity of media sheets remaining in the stack is sufficient to complete the proposed print job. As is also discussed above, such a predetermined minimum level of confidence can be maintained by way of known methods of statistical analysis.

As a result of the aforementioned evaluation to determine if the stack contains a sufficient number of media sheets to complete the proposed print job, a determination can be made that the number of media sheets contained in the stack is not sufficient to complete the proposed print job. Accordingly, an "add media" signal can be transmitted in response to determining that the estimated quantity of media sheets in the stack is not sufficient to complete the proposed print job.

A plurality of proposed print jobs can be provided in accordance with the method. That is, at least a first proposed print job and a second proposed print job can be provided. In that case, an evaluation can be made as to whether the estimated quantity of media sheets remaining in the stack is sufficient to complete the first proposed print job. Accordingly, a determination can be made that the quantity of media sheets remaining in the stack is not sufficient to complete the first proposed print job.

If such a determination is made, then in response thereto another evaluation can be made as to whether the estimated quantity of media sheets remaining in the stack is sufficient to complete the second proposed print job. Accordingly, after such an evaluation, a determination can be made that the estimated quantity of media sheets contained in the stack is sufficient to complete the second proposed print job. In such a case, the second proposed print job can be printed in response to determining that the estimated quantity of media sheets contained in the stack is sufficient to complete the second proposed print job.

In one variation of the above described method, two or more different processes of obtaining a quantitative measurement of the stack (e.g., weighing and measuring the height) can be used, and the estimated number of media sheets remaining in the stack MS using each quantitative measurement can then be combined and/or averaged to produce an estimate of the number of media sheets remaining in the stack. That is, two or more different types of quantitative characteristics, such as the stack weight and the stack height, can be utilized to obtain an estimated number of media sheets remaining in the stack.

For example, a difference in stack weight can be obtained for a given media stack as is described above. Furthermore, a difference in stack height can also be obtained for the given media stack. The difference in stack weight and the difference in stack height can be obtained either concurrently or successively, or the like. A respective estimated number of media sheets remaining in the stack can be determined for each difference as is described above in detail. Thereafter, these estimates can be compared and/or averaged in furtherance of determining an estimated number of media sheets remaining in the given media stack.

In accordance with another embodiment of the present invention, a method of dispensing media sheets from a stack of media sheets includes dispensing a number of media sheets from the stack, wherein the number of media sheets includes at least a first media sheet and a last media sheet. That is, the first media sheet is the first of the number of media sheets to be dispensed from the stack, while the last media sheet is the last of the number of media sheets to be dispensed from the stack.

The method also includes determining an initial thickness of the stack before the first media sheet is dispensed from the stack, and determining a final thickness of the stack after the last media sheet is dispensed from the stack. More specifically, the initial thickness of the stack is determined such that the first media sheet is the first media sheet dispensed from the stack after determining the initial thickness of the stack. Moreover, the final thickness of the stack is determined such that the last media sheet is the last media sheet dispensed from the stack before determining the final thickness of the stack.

Also in accordance with the method, the difference in the initial thickness of the stack and the final thickness of the stack is determined. That is, the difference between the initial thickness of the stack and the final thickness of the stack can be determined by subtracting the final thickness from the initial thickness. A ratio can then be established, wherein the ratio can be equal to the number of media sheets dispensed from the stack divided by the difference between the initial thickness of the stack and the final thickness of the stack.

Thus, the number of media sheets dispensed from the stack, wherein the number comprises at least the first media sheet and the last media sheet, corresponds to the difference between the initial thickness of the stack and the final thickness of the stack. That is, the dispensation of the number of media sheets from the stack, wherein the number of sheets dispensed includes at least the first media sheet and the last media sheet, accounts for the difference between the initial thickness of the stack and the final thickness of the stack.

An estimated quantity of media sheets remaining in the stack can then be established by multiplying the ratio by the final thickness of the stack. That is, the estimated quantity of media sheets remaining in the stack after the last media sheet is dispensed from the stack, but before any other media sheets are subsequently dispensed from the stack, can be established by multiplying the ratio by the final thickness of the stack.

In accordance with yet another embodiment of the present invention, a similar method of dispensing media sheets from a stack of media sheets also includes dispensing a number of media sheets from the stack of media sheets, wherein the number of media sheets includes a first media sheet and a last media sheet. As in the previously discussed method, the first media sheet is the first media sheet of the number of media sheets to be dispensed from the stack, while the last media sheet is the last of the number of media sheets to be dispensed from the stack.

The method also includes determining an initial weight of the stack before the first media sheet is dispensed from the stack, and determining a final weight of the stack after the last media sheet is dispensed from the stack. More specifically, the initial weight of the stack is determined such that the first media sheet is the first media sheet dispensed from the stack after determining the initial weight of the stack. Moreover, the final weight of the stack is determined such that the last media sheet is the last media sheet dispensed from the stack before determining the final weight of the stack.

Also in accordance with the method, the difference in the initial weight of the stack and the final weight of the stack is determined. That is, the difference in the initial weight of the stack and the final weight of the stack can be determined by subtracting the final weight from the initial weight. A ratio can then be, established, wherein the ratio can be equal to the number of media sheets dispensed from the stack divided by the difference between the initial weight of the stack and the final weight of the stack.

Thus, the number of media sheets dispensed from the stack, wherein the number comprises at least the first media sheet and the last media sheet, corresponds to the difference between the initial weight of the stack and the final weight of the stack. That is, the dispensation of the number of media sheets from the stack, wherein the number of sheets dispensed includes at least the first media sheet and the last media sheet, accounts for the difference between the initial weight of the stack and the final weight of the stack.

An estimated quantity of media sheets remaining in the stack can then be established by multiplying the ratio by the final weight of the stack. That is, the estimated quantity of media sheets remaining in the stack after the last media sheet is dispensed from the stack, but before any other media sheets are subsequently dispensed from the stack, can be established by multiplying the ratio by the final weight of the stack.

In accordance with yet another embodiment of the present invention, a method of dispensing media sheets from a stack of media sheets includes dispensing a first plurality of media sheets from the stack. However, a first quantitative measurement of the stack is obtained before the first plurality of media sheets is dispensed from the stack. Also, a second quantitative measurement of the stack is obtained after the first plurality of media sheets is dispensed from the stack.

A first delta measurement is established by subtracting the second quantitative measurement from the first quantitative measurement. That is, the first delta measurement is the difference between the first quantitative measurement and the second quantitative measurement. A first count is also established by counting the media sheets that make up the first plurality of media sheets. That is, the first count is established by counting the number of media sheets that are dispensed from the stack between the first quantitative measurement and the second quantitative measurement.

A first ratio can then be established by dividing the first count by the first delta measurement. That is, the first ratio can be defined as the first count divided by the first delta measurement, wherein the first delta measurement can be obtained by subtracting the second quantitative measurement from the first quantitative measurement. Thus, the first ratio can describe the relationship between the first plurality of media sheets dispensed from the stack and the associated difference in the first and second quantitative measurements.

Similarly, the method includes dispensing a second plurality of media sheets from the stack after the second quantitative measurement is obtained. Also, a third quantitative measurement of the stack is obtained before the second plurality of media sheets is dispensed from the stack. Also, a fourth quantitative measurement of the stack is obtained after the second plurality of media sheets is dispensed from the stack.

A second delta measurement is established by subtracting the fourth quantitative measurement from the third quantitative measurement. That is, the second delta measurement is the difference between the third quantitative measurement and the fourth quantitative measurement. A second count is also established by counting the media sheets that make up the second plurality of media sheets. That is, the second count is established by counting the number of media sheets that are dispensed from the stack between the third quantitative measurement and the fourth quantitative measurement.

A second ratio can then be established by dividing the second count by the second delta measurement. That is, the second ratio can be defined as the second count divided by the second delta measurement, wherein the second delta measurement can be obtained by subtracting the fourth quantitative measurement from the third quantitative measurement. Thus, the second ratio can describe the relationship between the second plurality of media sheets dispensed from the stack and the associated difference in the third and fourth quantitative measurements.

An average of the first ratio and the second ratio can be calculated in accordance with the method. That is, the first ratio and the second ratio can be added together, and then divided in half to obtain an average value for the first ratio and the second ratio. A fifth quantitative measurement of the stack can be obtained after the fourth quantitative measurement is obtained. Furthermore, an estimated quantity of media sheets remaining in the stack can be established by multiplying the fifth quantitative measurement by the average of the first ratio and the second ratio.

Also in accordance with the method, a proposed print job can be provided. An evaluation can be made in accordance with the method to determine whether the estimated quantity of media sheets remaining in the stack is sufficient to complete the proposed print job. It can be appreciated that the second quantitative measurement and the third quantitative measurement can be the same measurement. That is, a single quantitative measurement can be substituted for both the second quantitative measurement and the third quantitative measurement in the above explanation of the method. Furthermore, it is also understood that the method can be accomplished by an apparatus such as the apparatus 100 that is described above and shown in FIG. 1.

In accordance with yet another embodiment of the present invention, a method of dispensing media sheets from a given stack of media sheets includes dispensing a respective plurality of media sheets from each of a plurality of stacks of media sheets. A respective pair of respective quantitative measurements is obtained from each of the plurality of stacks, wherein the respective plurality of media sheets is dispensed between each measurement of the respective pair of quantitative measurements.

A respective count is established for each stack, wherein a given count is equal to a respective number of media sheets dispensed between each measurement of the associated pair of quantitative measurements. Furthermore, a respective ratio is established for each stack, wherein a given ratio is equal to the respective count divided by the difference between the respective pair of quantitative measurements.

Thus, for each of the plurality of stacks, a pair of quantitative measurements is obtained, and a plurality of media sheets is dispensed from the stack between the pair of measurements, and wherein a respective count is equal to the number of media sheets in the plurality of media sheets. Also, a respective ratio can be associated with each stack, wherein a given ratio is obtained by dividing the associated count by the difference in the pair of quantitative measurements.

A target quantitative measurement can be obtained for a given stack, and a mean value of the ratios can be calculated. Also, an estimated quantity of media sheets remaining in the stack can be established by multiplying the mean value of the ratios by the target quantitative measurement. The method can also include providing a proposed print job and evaluating whether the estimated quantity of media sheets remaining in the given stack is sufficient to complete the proposed print job. It is understood that the given stack can be one of the plurality of stacks.

It is also understood that each of the stacks can be formed and processed as described above either substantially concurrently, or in succession. That is, the method can be accomplished by way of employing a plurality of apparatus such as the apparatus 100 described above and shown in FIG. 1, wherein each of the plurality of stacks is formed and processed in an associated apparatus. Alternatively, the method can be accomplished by employing a single apparatus such as the apparatus 100, wherein the plurality of stacks are formed and processed in succession in the single apparatus.

Another method similar to the above-described method can include all of the above-described procedures except that of calculating a mean value of the plurality of ratios. More specifically, rather than calculating a mean value of the plurality of ratios, a similar method can include calculating a median value for the plurality of ratios, with substantially all other procedures being substantially the same as those of the above-described method.

That is, in accordance with still another embodiment of the present invention, a method of dispensing media sheets from a given stack of media sheets can include dispensing a respective plurality of media sheets from each of a plurality of stacks of media sheets and obtaining a pair of respective quantitative measurements from each of the plurality of stacks, wherein the respective plurality of media sheets is dispensed between each measurement of the respective pair of quantitative measurements.

A respective count is established for each stack, wherein a given count is equal to a respective number of media sheets dispensed between each measurement of the associated pair of quantitative measurements. Furthermore, a respective ratio is established for each stack, wherein a given ratio is equal to the respective count divided by the difference between the respective pair of quantitative measurements.

A target quantitative measurement can be obtained for a given stack, and a median value of the ratios can be calculated. An estimated quantity of media sheets remaining in the stack can be established by multiplying the median value of the ratios by the target quantitative measurement. As in the previously discussed similar method, the method at hand can also include providing a proposed print job and evaluating whether the estimated quantity of media sheets remaining in the given stack is sufficient to complete the proposed print job. It is understood that the given stack can be one of the plurality of stacks.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus, comprising:

a counting device adapted to count how many media sheets are dispensed from a stack of media sheets;

a measuring device adapted to measure a quantitative characteristic of the stack;

a processor in data-communicative linkage with both the counting device and the measuring device;

a computer readable memory device; and a set of computer executable instructions operatively resident within the memory device and executable by the processor, the set of computer executable instructions adapted to cause the processor to compute:

a plurality of ratios, wherein each ratio is a ratio of a respective change in the quantitative characteristic of the stack to a respective corresponding number of media sheets dispensed from the stack; and, an estimated number of media sheets remaining in the stack based on the ratios.

2. The apparatus of claim 1, and wherein the counting device is a top-of-form sensor.

3. The apparatus of claim 1, and wherein the measuring device is adapted to substantially detect a weight of the stack.

4. The apparatus of claim 1, and wherein the measuring device is adapted to substantially detect a thickness of the stack.

5. The apparatus of claim 1, and wherein:

the stack has a top and an opposite bottom; and the measuring device is adapted to substantially detect a position of the stack bottom relative to the top.

6. The apparatus of claim 1, and wherein the set of computer executable instructions is further adapted to cause the processor to calculate a mean value for the plurality of ratios, wherein the estimated number of media sheets remaining in the stack is based on the mean value.

7. The apparatus of claim 1, and wherein the set of computer executable instructions is further adapted to cause the processor to calculate a median value for the plurality of ratios, wherein the estimated number of media sheets remaining in the stack is based on the median value.

8. An apparatus, comprising:

a means for dispensing individual media sheets from a stack of media sheets in succession;

a means for counting how many media sheets are dispensed from the stack;

a means for measuring a quantitative characteristic of the stack; and, a means for computing:

a plurality of ratios, wherein each ratio is a ratio of a respective change in the quantitative characteristic of the stack to a respective corresponding number of media sheets dispensed from the stack; and, an estimated number of media sheets remaining in the stack based on the ratios.

9. An apparatus for estimating the number of media sheets remaining in a stack, comprising:

a processor;

a computer readable memory device; and, a set of computer executable instructions operatively resident on the memory device, and executable by the processor, the instructions adapted to cause the processor to compute:

a plurality of ratios, wherein each ratio is a ratio of a respective change in a quantitative characteristic of the stack to a respective corresponding number of media sheets dispensed from the stack;

a value selected from the group consisting of a mean value for the plurality of ratios and a median value for the plurality of ratios; and, an estimated number of media sheets remaining in the stack based on the value.

10. The apparatus of claim 9, wherein:

the set of computer executable instructions is further adapted to detect that a new stack has been formed; and, each of the plurality of ratios is computed in response to detecting that the new a new stack has been formed.

11. The apparatus of claim 10, further comprising a counting device configured to count media sheets dispensed from the stack.

12. The apparatus of claim 10, further comprising a measuring device adapted to substantially weigh the stack.

13. The apparatus of claim 10, further comprising a measuring device adapted to substantially measure a thickness of the stack.

14. The apparatus of claim 10, further comprising a picking device adapted to dispense individual media sheets from the stack.

* * * * *